US011781542B2

(12) United States Patent
Gayubas et al.

(10) Patent No.: US 11,781,542 B2
(45) Date of Patent: Oct. 10, 2023

(54) ROD ROTATOR ASSEMBLY FOR WELL PUMPING ROD STRINGS

(71) Applicant: DALTEC OIL TOOLS SRL, Buenos Aires (AR)

(72) Inventors: Nicolás Gayubas, Buenos Aires (AR); Martin Ruiz Palero, Buenos Aires (AR)

(73) Assignee: DALTEC OIL TOOLS SRL, Buenos Aires (AR)

( * ) Notice: Subject to any disclaimer, the term of this patent is extended or adjusted under 35 U.S.C. 154(b) by 30 days.

(21) Appl. No.: 17/737,433

(22) Filed: May 5, 2022

(65) Prior Publication Data

US 2022/0412339 A1 Dec. 29, 2022

(51) Int. Cl.

| | |
|---|---|
| ***F04B 47/02*** | (2006.01) |
| ***E21B 43/12*** | (2006.01) |
| ***E21B 17/10*** | (2006.01) |
| ***F04B 47/12*** | (2006.01) |

(52) U.S. Cl.

CPC ..... *F04B 47/026* (2013.01); *E21B 17/1071* (2013.01); *E21B 43/127* (2013.01); *F04B 47/12* (2013.01)

(58) Field of Classification Search

None

See application file for complete search history.

(56) References Cited

U.S. PATENT DOCUMENTS

| | | | | | |
|---|---|---|---|---|---|
| 558,421 | A * | 4/1896 | Rhoades | E21B 1/02 | 74/156 |
| 1,623,696 | A * | 4/1927 | Nugent | E21B 1/02 | 74/21 |
| 2,291,732 | A * | 8/1942 | Lay | E21B 7/021 | 175/320 |
| 2,318,315 | A * | 5/1943 | Johnston | E21B 43/127 | 74/21 |
| 2,409,104 | A * | 10/1946 | Cavaness | E21B 1/02 | 74/88 |
| 2,416,036 | A * | 2/1947 | Zimmerlein | E21B 7/021 | 475/14 |
| 2,444,842 | A * | 7/1948 | McConahey | E21B 43/127 | 24/122.3 |
| 2,534,213 | A * | 12/1950 | Alexander | E21B 3/02 | 173/152 |
| 2,556,536 | A * | 6/1951 | Harris | E21B 19/167 | 81/55 |
| 2,589,952 | A * | 3/1952 | Mercier | F16B 2/241 | 446/124 |

(Continued)

*Primary Examiner* — Bryan M Lettman
*Assistant Examiner* — Geoffrey S Lee
(74) *Attorney, Agent, or Firm* — Norris McLauhglin, P.A.

(57) ABSTRACT

A mechanical rod rotator assembly comprising a mechanical rod rotator and an actuating mechanism for a mechanical pumping rod rotator, wherein the mechanism comprises a connecting arm and a guide member that slidably embraces the pumping rod, in order to allow a pivoting lever that is in connection with said connecting arm, to interact with the internal mechanism of the rod rotator to gradually rotate the pumping rod and thus avoid impartial wear caused by the constant up and down reciprocating movement of the same within the well, being in turn that the mechanism of the invention does not require special tools for its assembly and installation.

9 Claims, 5 Drawing Sheets

(56) References Cited

U.S. PATENT DOCUMENTS

| | | | | | |
|---|---|---|---|---|---|
| 2,657,944 | A * | 11/1953 | Miller | E01B 25/10 | 403/362 |
| 2,870,715 | A * | 1/1959 | Barrett | F04B 47/02 | 417/85 |
| 3,004,784 | A * | 10/1961 | Selby | E04G 7/20 | 411/398 |
| 3,089,428 | A * | 5/1963 | Johnston | F16K 29/00 | 417/313 |
| 3,147,813 | A * | 9/1964 | Rezaeih | E21B 21/01 | 177/225 |
| 3,211,482 | A * | 10/1965 | Sorenson | F16B 7/105 | 403/108 |
| 3,499,324 | A * | 3/1970 | Wenisch | F04B 47/02 | 73/152.61 |
| 4,645,084 | A * | 2/1987 | Deike | B25J 9/1035 | 901/22 |
| 4,981,316 | A * | 1/1991 | McMahon | E21B 19/06 | 294/90 |
| 5,219,449 | A * | 6/1993 | Hoshino | F16B 7/0413 | 403/292 |
| 10,125,582 | B1 * | 11/2018 | Johnson | E21B 17/04 | |
| 11,248,739 | B1 * | 2/2022 | Jordan | F16M 11/28 | |
| 11,286,678 | B2 * | 3/2022 | Cerasi | E04G 7/301 | |
| 2003/0086756 | A1 * | 5/2003 | Trotter | B25B 23/0035 | 403/293 |
| 2004/0195801 | A1 * | 10/2004 | Lara | B60D 1/065 | 280/490.1 |
| 2018/0112475 | A1 * | 4/2018 | Scekic | E21B 19/06 | |
| 2020/0018127 | A1 * | 1/2020 | Cortes | E21B 17/1071 | |
| 2020/0278060 | A1 * | 9/2020 | Boggio | F16L 19/06 | |
| 2022/0235636 | A1 * | 7/2022 | Navar | F04B 47/026 | |
| 2022/0236082 | A1 * | 7/2022 | Navar | E21B 43/126 | |

* cited by examiner

ROD ROTATOR ASSEMBLY FOR WELL PUMPING ROD STRINGS

STATE OF THE ART OF THE INVENTION

Field of the Invention

The present invention relates to the field of pumping equipment for the oil industry and more particularly relates to a rod rotator assembly for mechanical pumping in oil wells, comprising a rod rotator and a rotator actuating mechanism, wherein the actuating mechanism, unlike conventional actuating arrangements, allows actuating the rod rotator in a safe manner without the need for steel cables or large external equipment, being its installation, operation and maintenance much more practical, easy, economical and fast without the need for special tools, and in turn, provides greater protection to the parts that constitute it, prolonging their useful life.

Description of the Prior Art

In the field of oil industry, numerous equipment and instruments are used for tasks of treatment and extraction of hydrocarbons in the well, such as, for example, well equipment provided with pumping tools and driving machinery having considerable volume, height and size. Generally, well equipment is provided with valves, cock valves, taps, pumping rods, downhole pumps, etc. to carry out the extraction of the crude oil (hydrocarbon). Particularly, in the extraction method by mechanical pumping, the pumping rods are in constant, ascending and descending, alternating movement, and suffer wear and deformation due to being in contact with the tubing, which can cause it to break and even disable extraction. Considering that oil wells are located in areas very far from urban centers, in the event of a failure or involuntary accidents, their repair can take a considerable period of time, which increases related production costs.

Usually, a mechanical well pumping equipment is provided with a pivoting beam and a hanger from which the rods that enter the well through the tubing are hung to activate an oil collector by means of the up and down movement of the pumping equipment that actuates the pumping rods to descend, load the oil, and ascend, to discharge it into collection containers. The pumping equipment is a rod pump, generally called Beam Pumping Unit, popularly also known as a pumpjack, which supports or holds the entire assembly of pumping rods or sucker rod string, that enter inside the well and transmits them the necessary reciprocating movement to carry out the pumping operation of the downhole pump. On the hanger of the pumping equipment it is possible to include a device called a rod rotator whose function is to rotate the entire assembly of rods, namely the sucker rod string, on their axis during their reciprocating movement in order to reduce their wear as well as to protect them against deformation, to facilitate their homogeneous wear, and increase their useful life, etc.

In relation to the operation of the rotator, as mentioned above, it allows the rods to rotate by taking advantage of the alternative movement of the pumping unit through an internal mechanism that in each ascent and descent stroke makes a rotation of the upper rotator cover that is in contact with the clamp that holds the polished rod and the pumping rods. This is achieved thanks to the fact that the rotator has an external pivoting arm or lever, which actuates the internal rotation mechanism of the cover. This outer arm can alternately pivot up and down. In older equipment, the pivot arm is connected at one end to a steel cable which is attached to a part of the pumping equipment known as the "horsehead" and this carries the pivot arm up as it goes up and down when lowered, thus activating the internal mechanism of the rotator.

However, one of the drawbacks involved in this type of arrangement is that the steel cable generally gets caught in other parts of the equipment. These drawbacks occur in any area but are most probable in very windy areas such as Patagonia, causing the cables to break and thus stopping the operation of the rod rotator system. Consequently, and taking into account the large dimensions of the installation at the wellhead and the height of the horsehead, to reinstall the cable and start up the rod rotator again, it is necessary to resort to the services of at least one crane, for example a hydrocrane and specialized personnel, to reinstall the steel cable on the horsehead, further increasing costs.

In a more modern piece of equipment, disclosed in Patent AR067179B1, there is a support for actuating the pivoting arm or rotator lever) of the rod rotator that comprises a support that is fixedly mounted and adjacent to the wellhead equipment in order to avoid the use of cables. Said support comprises an extensible column that has a lower section provided with fastening means to the wellhead equipment and with at least one support foot. In relation to operation, to actuate the pivoting arm or rotator lever, the extensible column has an upper end having a contact portion preferably comprised of a transverse contact arm. In this way, when the hanger lowers, the rotator lever contacts the transverse arm of the support and rotates upwards. As the hanger rises, the pivot arm releases contact with the transverse arm and rotates downward under its own weight. In this way, the rotator lever pivots up and down constantly, allowing the actuation of the internal mechanism of the rotator which, each time the pivoting arm passes from its upper angular position to its lower angular position, rotates the rotator lid through the internal mechanism and in turn transmits the movement to the set of pumping rods.

Although the use of cables to actuate the rotator is avoided, this type of arrangement entails the use of large external equipment that occupies physical space that could be used for other purposes. In addition, it may be the case that the transverse arm of the column changes position and becomes dislodged, or for various reasons, or weather reasons, it remains stuck in a position in which the pivoting arm does not come into contact with it, and consequently, the rotation of the rods cannot be generated through the rotator. Likewise, the use of an external equipment such as the one described above, causes the personnel in charge of maintenance at the wellhead to operate under uncomfortable conditions, thus having to take greater precautions to avoid causing accidents and delaying even more the maintenance process or repair.

Another disadvantage of this actuation method is that the constant contact and impact of the pivoting arm of the rotator with the transverse arm of the support can cause premature wear of the rotator arm, with the consequence of its being disabled due to wear or shearing.

As a result of the foregoing, the holder of this application has developed a mechanism for actuating the rod rotator in accordance with the Argentine Patent Application Series P20140101510, which describes an actuating mechanism for the pumping rod rotator, which avoids the use of cables or external equipment that may affect installations and site personnel due to failures or involuntary accidents. Said mechanism transmits the movement to the pivoting arm of the rotator that goes up and down, thus actuating the internal mechanism of the rotator to rotate the upper cover and in turn transmit the movement to the coupling or clamp and this to the polished rod and the pumping rods. The mechanism is comprised of at least one lower end and one upper end connected to said pivoting arm, and at least one guiding means that is connected to said lower end and that is arranged around said polished rod and that is slidably coupled along it.

Likewise, Patent Document CO 6790241 discloses a polished rod rotator actuating mechanism for pumping units. Wherein, the mechanism comprises a head, a smooth bar, a rotator with a rotator arm and a dovetail, characterized in that it comprises a sliding element comprising a cup inside which a rubber bushing is placed which is connected to a connecting element with positioning holes through an anchor screw, and to said rotator arm through a fastening screw; the mechanism also being provided with a stop.

Although the Argentine Patent Application Series P20140101510 and Patent CO 6790241 provide a practical solution to avoid the use of cables and external equipment, they lack protection against premature wear of the parts during the ascending-descending stroke of the polished rod, which causes metal-to-metal contact to occur between it and the respective part of the mechanism. In turn, both mechanisms are assembled and adjusted using special tools, and the height adjustment, in both cases, has a vertical bar or a multi-perforated connection element that leaves protruding portions at the bottom and top of the mechanism that have been shown to come into contact with the well base or other components or equipment and even operating personnel and cause accidents.

In the case of Colombian Patent CO 6790241, it discloses an element called "cup" that contains inside a rubber bushing that is in permanent contact with the polished rod, so that it requires more maintenance and replacement due to frictional wear. The cup is closed by means of an adjustment screw and nut, requiring tools for its installation. This metal cup also rests on the wellhead stuffing box, producing metal-to-metal contact that can lead to premature component wear. In turn, the cup, which is a piece in constant movement, does not have any warning sign, for example a reflective one.

Likewise, Colombian patent CO 6790241 cites an element called a connection element which, in order to adjust the actuation height, must shorten the distance between the cup and the arm of the rotator. Shortening this distance, part of the connection element is exposed, either at the top or at the bottom. The connection element is coupled to the cup and the rotator lever by means of screws and nuts, requiring tools and also a very precise adjustment that allows the rotation of the arm since if it is adjusted with high torque it can lock the rotator arm and therefore it cannot rotate causing breakage of the parts.

This brings with it a high level of difficulty since related tools are needed, in addition to being inefficient because its adjustment must be very precise, so as not to be so tight that it makes rotation difficult, nor so loose that it causes undesirable movements, permanently requiring to verify the function of the adjusting screw. In addition, Document CO 6790241 mentions an element called an extension that is coupled to the connection element. The coupling between said elements requires, according to the patent, 3 adjustment screws and nuts, requiring the use of manual tools in addition to a correct adjustment to prevent the screws from unscrewing over time and use. In short, it is a mechanism that involves many pieces and connections that are not advisable for what is an environment far from any urban center.

Under the current state of the art, it would be highly desirable to have a new rod rotator assembly that combines a new rod rotator and a new rod rotator actuating arrangement or mechanism that is constituted and constructed to prevent premature wear of the parts and involuntary accidents due to the collision between parts of the mechanism, as well as that guarantees the position of the rotator arm so that it never aligns with the applied force of the actuating mechanism, while allowing easy assembly and regulation in a practical, fast and easy way without the need for related tools.

BRIEF DESCRIPTION OF THE INVENTION

It is therefore an object of the present invention to provide a new rod rotator assembly that includes an actuating mechanism that avoids the use of cables or external equipment that may affect installations and site personnel due to failures or involuntary accidents.

It is yet another object of the present invention to provide a rod rotator assembly comprising a rod rotator actuating mechanism, the installation, operation and maintenance of which is more practical and faster without the need to use related tools.

It is also another object of the present invention to provide a rod rotator assembly that includes a drive mechanism that is installed directly around the polished rod and that prevents premature wear of the parts, thus optimizing their useful life.

It is yet another object of the present invention to provide a pumping rod rotator assembly comprising an actuating mechanism that absorbs shocks in order to further increase the life of the parts and reduce maintenance.

It is still another object of the present invention to provide a sucker rod rotator assembly comprising a rod rotator including an arm stop or lever stop that limits the movement of the rotator arm in order to guarantee an effective movement thereof, preventing the arm from aligning with the direction of the application of actuating forces and thus avoiding breakage due to unwanted movements.

It is yet another object of the present invention to provide a rod rotator assembly comprising a mechanical rod rotator and an actuating mechanism for the rod rotator, wherein the actuating mechanism has a lower part mounted around a first pumping rod or polished rod and an upper part connected to said rod rotator which is provided with a pivoting arm that rises and falls capable of rotating an internal mechanism of the rotator during the ascent and descent of the arm to rotate an internal mechanism (worm gear) and upper rotator cover to the upper clamp or coupling and thus to said first pumping rod or pumping polished rod gradually, and therefore to the entire string of rods, wherein:

the actuating mechanism comprises at least one tube that includes respective extension tubes, being that it can be at least an integral one, and preferably for the invention but not limiting thereto, at least an upper one and at least a lower one, coupled to each other by means of a coupling means and respective fixing elements, said upper extension tube being connected at the top to said pivoting arm of the rotator, while said lower extension tube is provided with a height adjustment means that moves guided and longitudinally along inside it and which is selectively fixed between height adjustment positions by means of a fixing element that passes through said lower extension tube and said height adjustment means;

at least one guide element that is connected to said lower end of said at least one tube and which is removably arranged around said pumping rod or polished rod, being slidably coupled along it and having damping elements; and wherein, said rotator has at least one stop means comprising an auxiliary arm which has a first end mounted on a pivot point of the pivoting arm of said rotator and a free end that comes into operative contact with a stop arranged on a side of said rotator.

BRIEF DESCRIPTION OF THE DRAWINGS

For greater clarity and understanding of the object of the present invention, it has been illustrated in several figures, in which the invention has been represented in one of the preferred embodiments, all by way of example, wherein.

DETAILED DESCRIPTION OF THE INVENTION

Figure 1:
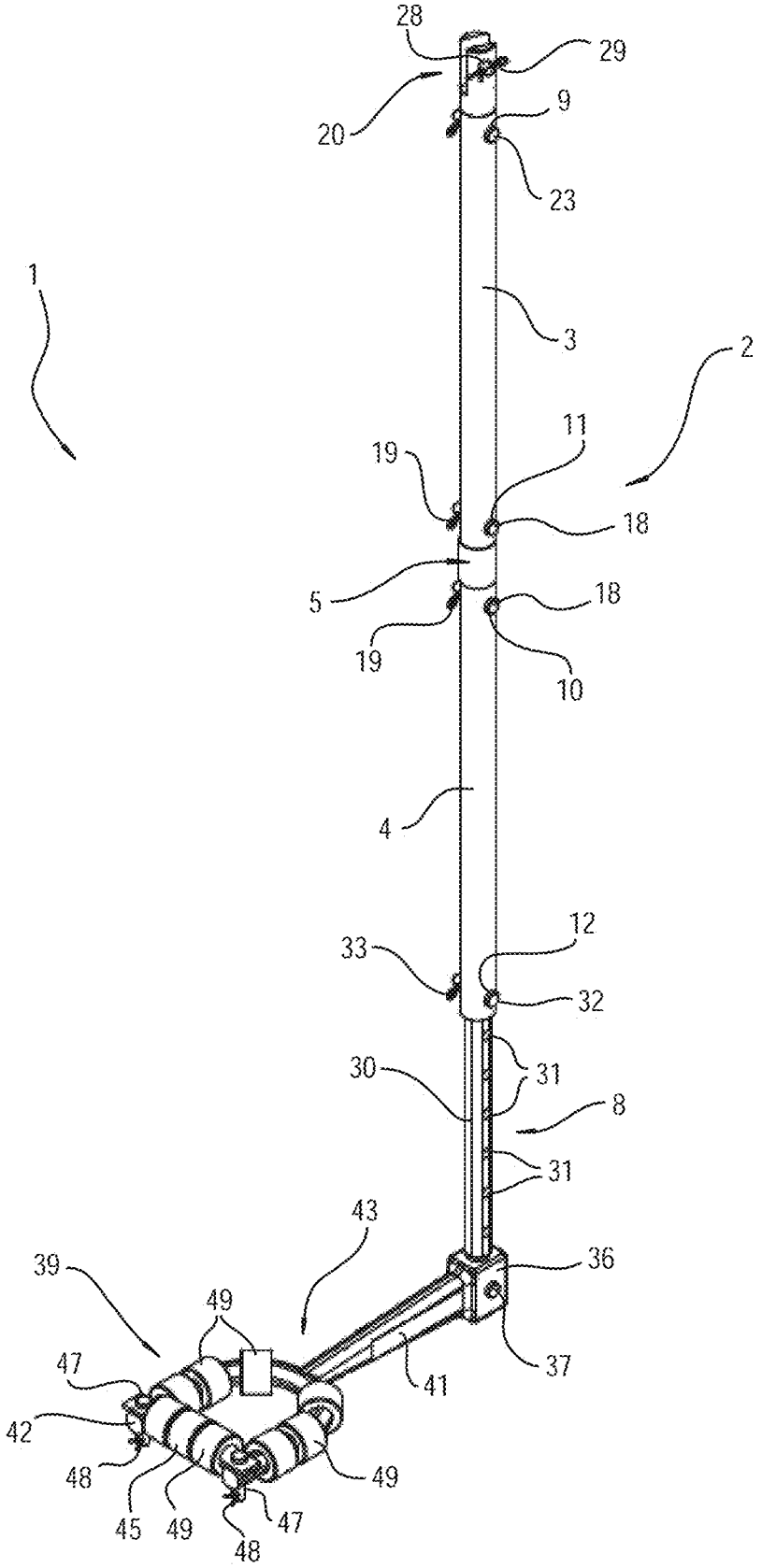
FIG. 1 shows a perspective view of the rotator actuating mechanism of the rod rotator assembly according to the present invention.
Figure 2:
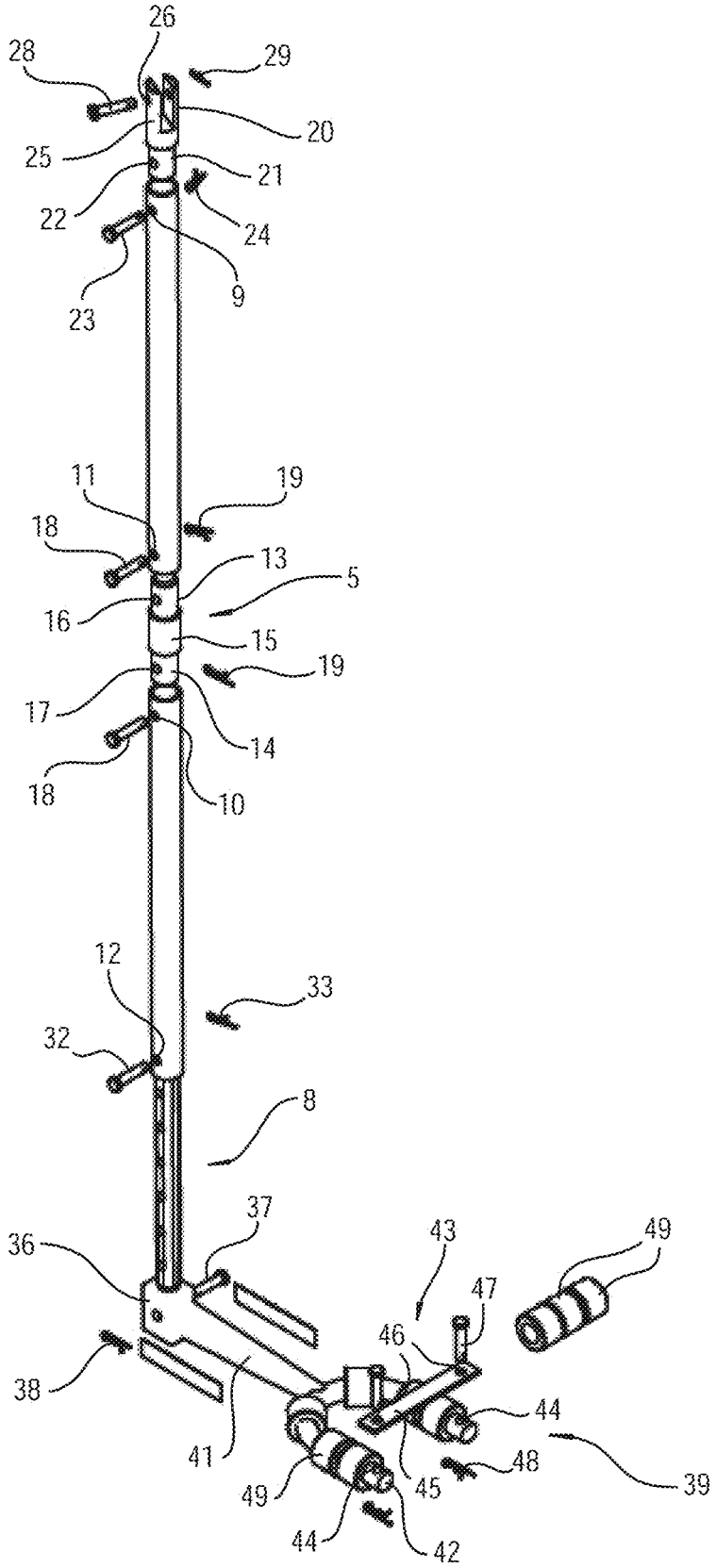
FIG. 2 shows an exploded perspective view of the actuating mechanism according to the present invention.
Figure 3:
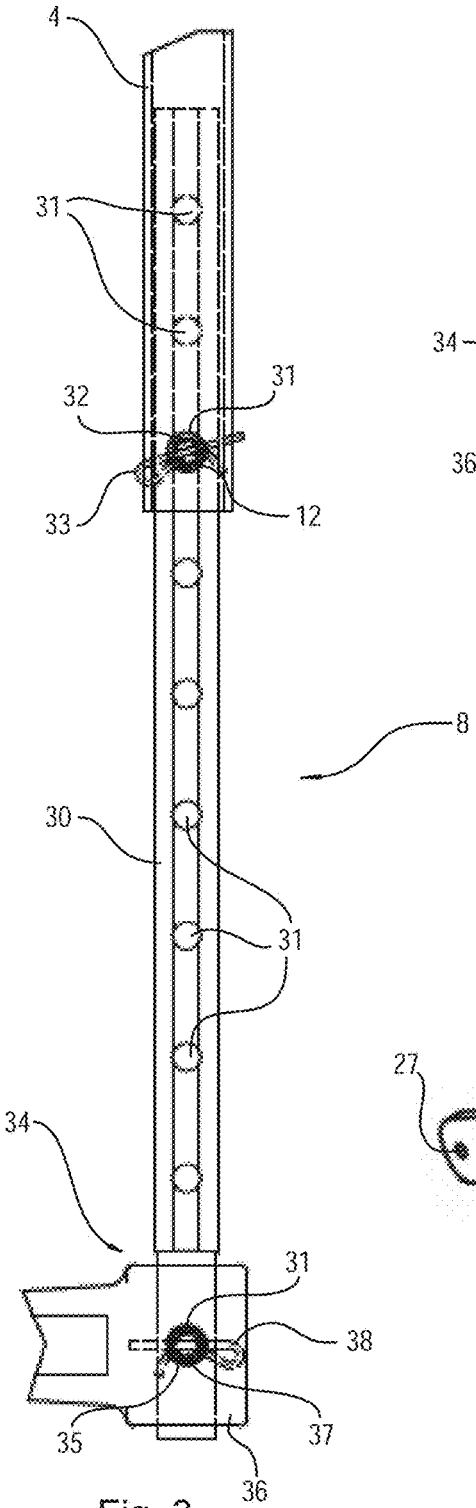
FIG. 3 shows an enlarged sectional view of a lower portion of a tube of the actuating mechanism of the rotator assembly according to the invention.
Figure 4:
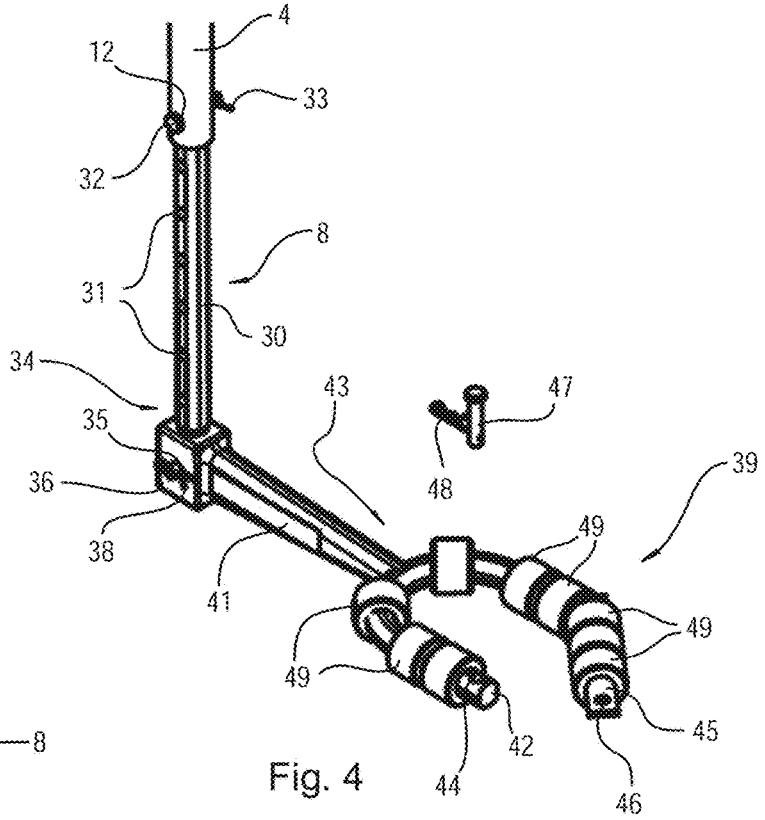
FIG. 4 shows an enlarged perspective view of an end portion of the actuating mechanism of the invention, which is mounted around the polished rod.
Figure 5:
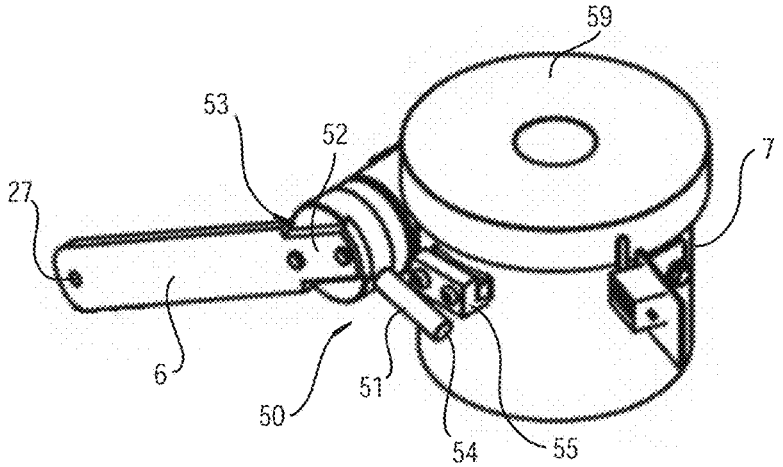
FIG. 5 shows a perspective diagram of a rod rotator of the rod rotator assembly, wherein the rotator has a stop according to the present invention.
Figure 6:
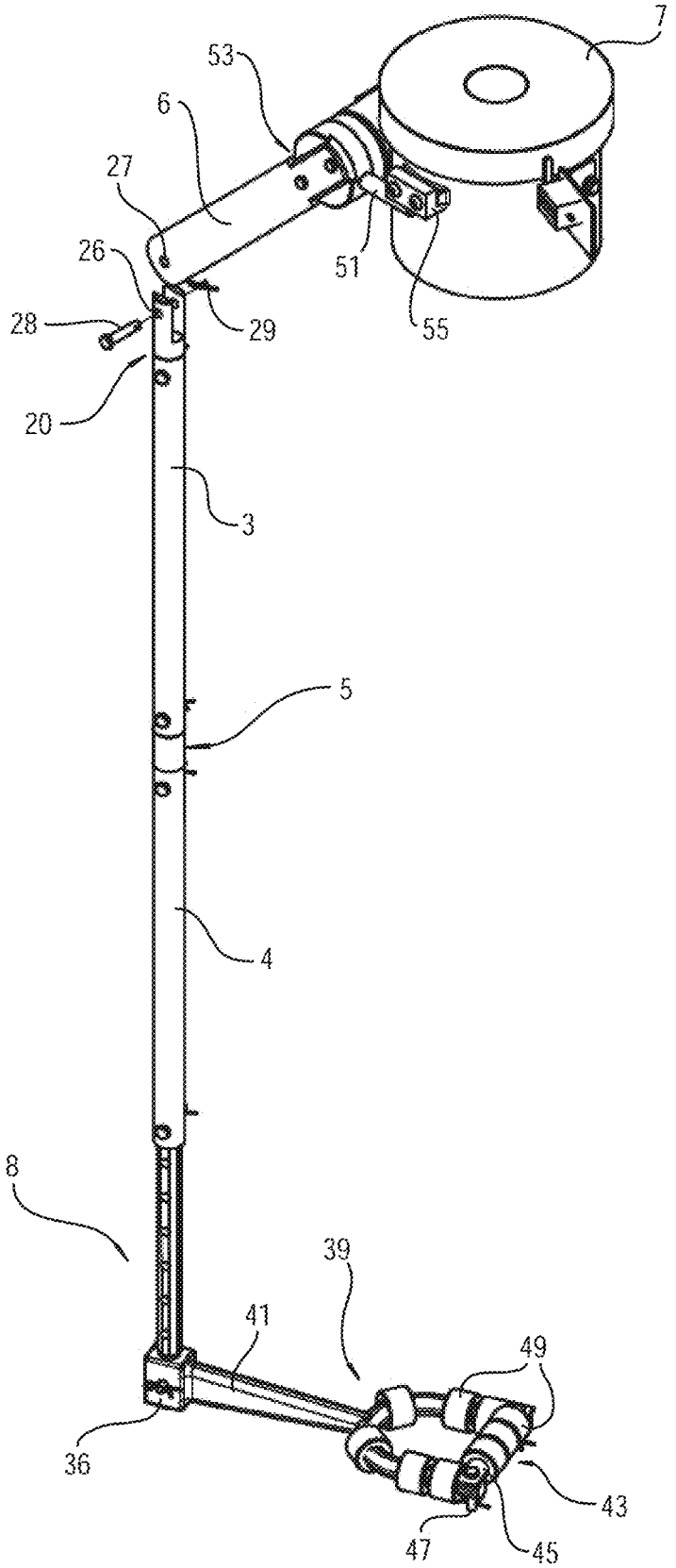
FIG. 6 shows a perspective view of the pumping rod rotator assembly of the invention.

Referring now to the figures, it can be seen that the invention relates to a new sucker rod rotator assembly comprising a rod rotator for the oil industry and an actuating mechanism for the rod rotator, either for extraction of oil, gas or water, which allows the rotation of the pumping rods in a gradual and practical way, avoiding impartial (localized) wear in their external structure, in their connection couplings and in the inner diameter of the "tubing" or piping. Likewise, by means of the pumping rod rotator assembly of the invention, the use of cables or external equipment that occupy considerable physical space and that, in cases of failures or weather changes that may generate involuntary accidents, may be detrimental to installations and site personnel, is avoided, also avoiding the use of special tools for its installation and extending the useful life of the parts that comprise it.

Thus, the pumping rod rotator assembly of the invention comprises an actuating mechanism for a mechanical pumping rod rotator that is indicated by general reference 1 and comprises at least one tube 2 that may comprise one or more extension tubes, at least an upper one 3 and at least a lower one 4 coupled to each other by means of a coupling means 5 or respective fixing elements. Wherein, said upper extension tube 3 is connected at a top part thereof to a pivoting arm or lever 6 of a rod rotator 7 which also forms part of the pumping rod rotator assembly of the invention. The lower extension tube 4 is provided with a height adjustment means 8 that moves guided and longitudinally along the interior of tube 8 and which is selectively fixed between height adjustment positions by means of a fixing element that passes through said lower extension tube 4 and said height adjusting means 8.

Although the use of an upper and a lower tube is mentioned, this is not limiting for the invention, since a plurality of tubes of different sizes can be used depending on the requirements of each installation, as well as a single tube connected to the pivoting arm of the rotator and to the height adjustment means. In the case of using more than two extension tubes, a corresponding number of coupling means 5 shall be used for the respective connection between the parts. For its part, if a single tube is used, the coupling means 5 is annulled, having the single extension tube both in its upper part and in its bottom or lower part, the corresponding construction features to carry out the connection with both the pivoting arm 5 and the height adjusting means 8, and said features will be described below.

Each of said upper 3 and lower 4 extension tubes have upper 9-11 and lower 10-12 through holes, respectively. Likewise, said coupling means 5 of the upper and lower 4 tubes, comprises end portions 13-14 slightly smaller in diameter than the inner diameter of said tubes 3-4 so as to be able to fit into them, and an intermediate portion 15 of approximately equal diameter to the external diameter of said tubes 3-4, being that said end portions 13-14 of smaller diameter have respective through holes 16-17, being at least one, for example 16 but not limited thereto, in coincidence with the hole lower through hole 11 of the upper tube 3, while the other, for example 17 but not limited thereto, being in coincidence with the upper hole 10 of the lower tube 4, passing through it said fixing elements that comprise pins 18 and cotters 19.

It is emphasized that all the cotters used in the present invention can be of the R type, this not being a limitation for the invention since other types of fixing elements can be considered and used without any inconvenience, as long as they do not require the use of special tools for their placement that may lead to the usual problems in conventional mechanisms used in the field of art.

For its part, said upper extension tube 3 is connected to said pivoting arm 6 of the rod rotator 7 through an arm terminal 20 that has a lower portion 21 that can be fitted inside said upper tube 3, being a through hole 22 thereof in coincidence with the upper hole 9 of said upper tube 3 and fixed through a pin 23-cotter 24 assembly; and an upper portion 25 in the form of a fork having a through hole 26 that is in linear coincidence with a hole 27 provided at one end of said pivoting arm 6 of the rotator 7, being fixed thereto through a pin 28 and cotter 29.

Likewise, said height adjusting means 8 comprises an adjustment bar or arm 30 provided with a plurality of adjustment holes 31 which are selectively coincident with the lower hole 12 of said lower extension tube 4, being that said fixing element of both parts, comprises a pin 32-cotter 33 assembly. In this way, the height adjustment or telescopic actuation of the tube 2 is allowed, with said bar or arm 30 moving inside the lower extension tube 4, avoiding projections that could cause accidents or contact with other wellhead elements. In turn, said height adjusting means 8 has a lower end 34 provided with a last through hole 31 which coincides with a through hole 35 of a fork-shaped guide element 39, more particularly of a fork base 36, said lower end of the height adjusting means 8 being fixed to said base 36 through a pin 37-cotter 38 assembly.

For its part, it is highlighted that said guiding element 39 rests on a stuffing box 57 and transmits the movement to the pivoting arm of the rotator. It also works as an actuating guide through the polished rod. It is important to clarify that its function is to guide and it is not in permanent contact with the polished rod since it has protection means that will be described below. Said guide element 39 is connected to said bottom or lower part or end 34 of said at least one tube 2 through said base 36 of the fork and which is removably arranged around a first pumping rod or polished rod 40, being slidably coupled along it. Wherein, said guide element or fork 39 comprises a longitudinal proximal part 41 that is defined by said fork base 36, while each of the free ends 42 of the distal "U" part 43 has a through hole 44, wherein in turn a pivoting closing means 45 is provided with end holes 46 coinciding with the through holes 44 of the free ends of the fork 43 and fixed by means of respective pin 47-cotter 48 assemblies.

Said longitudinal proximal part 41 of the fork can be provided with an identifying means such as a reflective tape to identify the corresponding part at night or when there is poor visibility. While said pivoting closure means 45 pivots at one end, so that assembly on the polished rod is very simple, the closure means 45 is opened, being placed around the rod and closed by means of the pin and cotter without using special tools.

It is emphasized that, as can be seen, the present invention uses fixing elements such as pins and cotters R that do not require special tools, providing functionality and simplicity when assembling and/or replacing parts, thus optimizing installation times and related costs. Likewise, in order to reduce wear due to friction or rubbing and extend the useful life of the guiding means 39 and of the rod 40, said "U" part 43 of the fork and said closing means 45, have a plurality of damping elements 49 comprising respective wheels made of plastic material that can be, but are not limited to the invention, made of plastic material.

On the other hand, to prevent the pivoting arm 6 of the rod rotator 7 from positioning itself vertically causing the mechanism to jam and break, it is provided with at least one stop means 50 comprising an auxiliary arm 51 which has a first end 52 mounted on a pivot point 53 of the pivoting arm 6 of said rotator 7 and a free end 54 that comes into operative contact with a stop 55 arranged on one side of said rotator 7. Wherein, said auxiliary arm 51 is inclined with respect to the longitudinal development of the pivoting arm 6 of the rod rotator 7, forming an angle between 45° and 0° which prevents the pivoting arm 6 from being positioned vertically when a beam pumping unit 56 is at its top dead center (TDC). That is, the rotator housing has a fixed horizontal stop 55. The pivoting arm 6 of the rotator has the free end 54 that abuts against the fixed stop 55 and does not allow the arm 6 of the rotator to be positioned vertically, in this way when activating the mechanism the force exerted is perpendicular to the lever arm exerted by the pivoting arm 6 and not collinear to its center of rotation, preventing the pivoting arm 6 from getting stuck.

It is emphasized that the internal mechanism of the rod rotator 7 is widely known in the field of art and that for such reasons, we will not go into descriptive details about it, being the novel stop means 50 of the invention complementary and indispensable for the movement of the pivoting arm 6 and being able to be added to any known rod rotator, in order to avoid jamming and breakage of the parts that comprise it. The purpose of the new stop is to prevent the pivoting arm from being aligned with the work force in some random movement, which would generate breakage and render the equipment unusable. The arm shall always keep an angle with respect to the vertical to be able to pivot faced to the change of direction of movement of the rods, that is, the change from ascent to descent and vice versa.

In this way, the mechanical pumping rod rotator assembly of the present invention is constituted and built, which avoids the use of special tools, extends the useful life of the parts and reduces related costs thus improving the assembly and installation process in a much more practical, fast and easy way.

Figure 7:
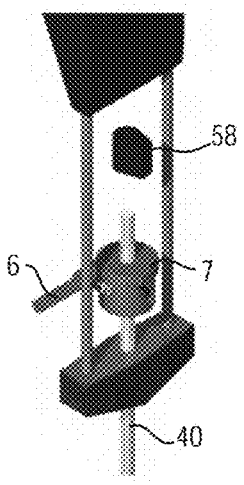
FIGS. 7 to 9 show different views of the possible stages of the installation of the pumping rod rotator assembly of the invention.
Figure 8:
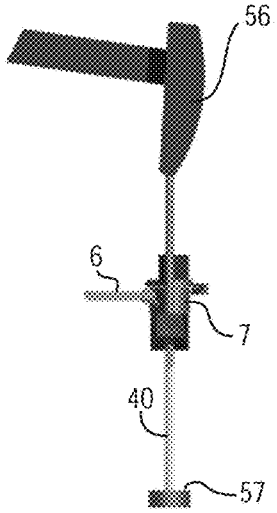
Figure 9:
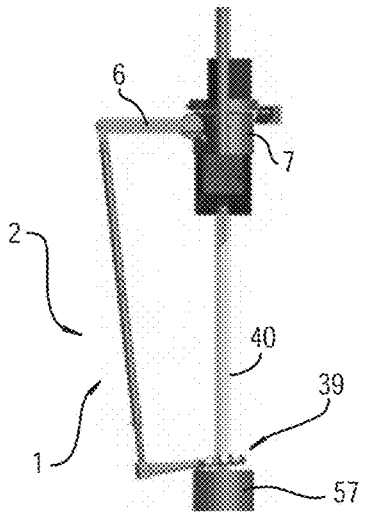

According to FIGS. 7 to 9, and with respect to the installation of the mechanism of the invention, it is possible to proceed, this not being limiting for the invention, as follows:

1. PLACING THE ROD ROTATOR ON HANGER—FIG. 7:
   - a) Stop and unload the pumping unit 56
   - a1) According to company safety procedures and regulations.
   - b) Remove the clamp from the polished rod 58
   - b1) Remove spacers only for some markets like Argentina.
   - c) Install rod rotator 7 (without actuation mechanism)
   - c1) Check that the pivoting arm or lever 6 of the rotator is at a safe distance from the bridle.
   - c2) Check that there are no interferences between the pivoting arm or lever and other nearby devices.
   - d) Re-place the polished rod clamp 58.
   - d1) Remove a ⅝" spacer to maintain the pump height. (specific or only for Argentina)
   - d2) Leveling disc, Leuter device, load cell, rod rotator, spacers, coupling. (only or specific for Argentina)
2. MEASURING DISTANCE FOR ACTUATOR—FIG. 8:
   - a) Load the pumping unit 57 and stop it at BDC.
   - a1) Stop the pumping unit at the Bottom Dead Center (Head Down).
   - b) Measure distance to assemble ACTUATOR
   - b1) Measure the distance between the contact surface of the stuffing box 57 and the pivoting arm or rotator lever 6 of the rotator 7 in the horizontal position (activation position).
3. ASSEMBLING/INSTALLING ACTUATOR—FIG. 9:
   - a) Assemble actuator
   - a1) Add the extension tubes that will form tube 2 and that are necessary to approximate the measured distance.
   - a2) Join the tubes by means of said coupling means, pins and cotters.
   - b) Install actuator
   - b1) Place the Terminal coupling or arm coupling or lever coupler 20 of the actuating mechanism at the end of said pivoting lever 6 of the rod rotator 7 by means of a pin and cotter.
   - b2) Adjust the height of the adjustment bar 30 to the measured distance.
   - b3) Place the fork around polished rod and close by placing pin and cotter.

Figure 10:
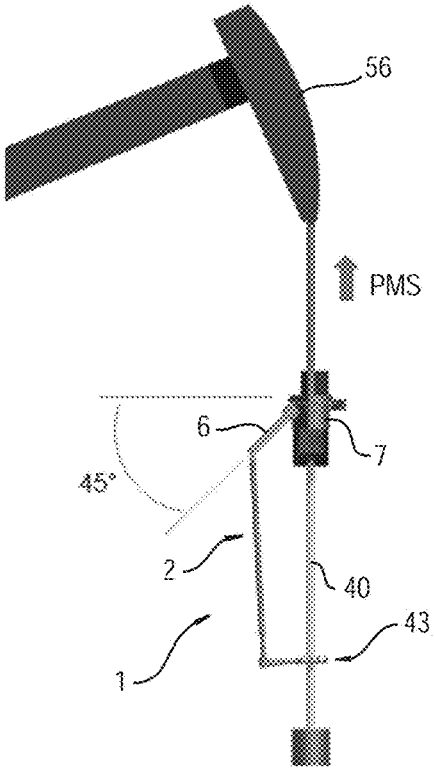
FIGS. 10 and 11 show views of the movement performed by the rod rotator assembly of the invention when the pumping rods ascend or descend in operation.
Figure 11:
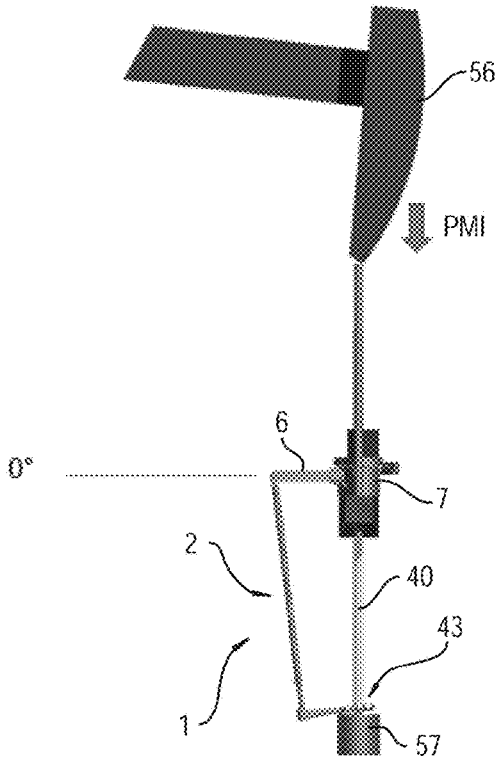

Once the assembly of the invention has been installed, the operation is verified, according to FIGS. 10 and 11, wherein at the Bottom Dead Center (FIG. 11), the pivoting arm 6 is positioned horizontally and activates the mechanism of rotation of the rotator 7, verifying that the rotator cover 59 rotates using as a reference a visual position indicator conveniently arranged on the cover

We claim:

1. A rod rotator assembly for well pumping rod strings of the type comprising a mechanical rod rotator and an actuating mechanism for the rod rotator, wherein the actuating mechanism has a lower part mounted around a first sucker or polished rod and an upper part connected to said rod rotator which is provided with a pivoting lever that rises and falls capable of rotating an internal mechanism of the rotator during up and down movement of the pivoting lever to rotate an upper rotator cover, which upper rotator cover in turn rotates an upper coupling or clamp of said first sucker or polished rod, to rotate the string of rods, wherein the actuating mechanism comprises, at least one tube having a top part connected to said pivoting lever, and a bottom part, height-adjusting means guided and telescopically extending along an interior of the at least one tube to be selectively fixed between different height adjustment positions, to reciprocally actuate said at least one tube, a fixing element passing through the at least one tube and said height adjustment means to fix said height-adjusting means to the at least one tube in a desired position, at least one fork-shaped guide element having a fork part removably extending around the rod string and a fork base connected to a bottom part of the height-adjusting means and, damping elements located at said fork part around the rod string, and wherein, said rod rotator has at least one stop means comprising an auxiliary arm which has a first end mounted on a pivot point of the pivoting lever of said rod rotator and a free end that comes into operative contact with a stop arranged on a side of said rod rotator.

2. A rod rotator assembly according to claim 1, wherein said at least one tube comprises at least an upper extension tube and at least a lower extension tube, coupled to each other by means of coupling means, said upper extension tube being connected at a top thereof to said pivoting lever, while said lower extension tube is provided with said height adjusting means, and said upper and lower extension tubes each has respective upper and lower through holes.

3. A rod rotator assembly according to claim 2, wherein said coupling means for connecting the upper and lower extension tubes, comprises end portions having smaller diameters than an internal diameter of said upper and lower extension tubes, and an intermediate portion having a diameter approximately equal to an external diameter of said upper and lower extension tubes, and said end portions of the coupling means having smaller diameter have respective through holes, to coincide with the respective upper and lower through holes of said upper and lower extension tubes, the through holes of the end portions of the coupling means and the through holes of the upper and lower extension tubes receiving pins and cotters.

4. A rod rotator assembly according to claim 2, wherein said upper extension tube is connected to said pivoting lever of the rod rotator through a lever coupler that has a lower portion fitted inside said upper extension tube, said lower portion of the lever coupler having a through hole for coinciding with the upper through hole of said upper extension tube for receiving a fixing pin-cotter assembly; the lever coupler having a fork-shaped upper portion having a through hole for connecting to a through hole provided at one end of said pivoting lever by a pin and cotter.

5. A rod rotator assembly according to claim 2, wherein said height adjusting means comprises an adjustment bar provided with a plurality of adjustment holes which are selectively connectable to the lower through holes of the lower extension tube by pin-cotter assembly.

6. A rod rotator assembly according to claim 1, wherein said height adjusting means has a lower end provided with a least a through hole connectable to a through hole of the fork base, said lower end of the height adjusting means being fixed to said fork base by a pin-cotter assembly.

7. A rod rotator assembly according to claim 1, wherein the for shaped guide element has a "U" shape with free ends and pivoting closing means are provided, with the pivoting closing means having a first end pivotally connected to one of the free ends of the "U" and a second end removably connectable to the opposite free end of the "U", and the second end of the pivoting closing means and the opposite end of the free ends of the "U" have respective through holes by pin-cotter assembly.

8. A rod rotator assembly according to claim 7, wherein said damping element comprises a plurality of damping wheels along said "U" shape of the fork part and said closing pivoting means.

9. A rod rotator assembly according to claim 1, wherein said auxiliary arm is arranged at an angle between 0° and 45° in respect to the pivoting lever.

* * * * *